US008627895B2

(12) United States Patent
Fern et al.

(10) Patent No.: US 8,627,895 B2
(45) Date of Patent: Jan. 14, 2014

(54) RUNNING TOOL

(75) Inventors: Robert Fern, Yorkshire (GB); Ted Thornburrow, Yorkshire (GB)

(73) Assignee: Cameron International Corporation, Houston, TX (US)

( * ) Notice: Subject to any disclaimer, the term of this patent is extended or adjusted under 35 U.S.C. 154(b) by 497 days.

(21) Appl. No.: 12/739,227

(22) PCT Filed: Oct. 13, 2008

(86) PCT No.: PCT/EP2008/063696

§ 371 (c)(1),
(2), (4) Date: Sep. 1, 2010

(87) PCT Pub. No.: WO2009/053264

PCT Pub. Date: Apr. 30, 2009

(65) Prior Publication Data

US 2010/0314129 A1 Dec. 16, 2010

(30) Foreign Application Priority Data

Oct. 24, 2007 (EP) ..... 07119227

(51) Int. Cl.
*E21B 23/00* (2006.01)

(52) U.S. Cl.
USPC ..... 166/382; 166/378; 166/379

(58) Field of Classification Search
USPC ..... 166/75.11, 75.14, 85.1, 338, 341–343, 166/351, 360, 368, 378–380, 348, 382, 166/85.5; 74/22 R, 89.14, 425, 500, 339; 173/104, 109, 112
See application file for complete search history.

(56) References Cited

U.S. PATENT DOCUMENTS

| | | | |
|---|---|---|---|
| 1,072,282 | A | 9/1913 | Waninger |
| 2,368,332 | A | 1/1945 | Shaffer |
| 2,471,198 | A | 5/1949 | Cormany |
| 2,542,388 | A | 2/1951 | Brohead |
| 2,595,434 | A | 5/1952 | Williams |
| 2,693,238 | A | 11/1954 | Baker |
| 3,239,246 | A | 3/1966 | Barber |
| 3,688,841 | A | 9/1972 | Baugh |

(Continued)

FOREIGN PATENT DOCUMENTS

| | | |
|---|---|---|
| EP | 0370744 A1 | 5/1990 |
| EP | 0251595 A2 | 1/1998 |

(Continued)

OTHER PUBLICATIONS

PCT/EP2008/063696 International Search Report and Written Opinion, Mar. 3, 2009.

(Continued)

*Primary Examiner* — David Bagnell
*Assistant Examiner* — Taras P Bemko
(74) *Attorney, Agent, or Firm* — Chamberlain Hrdlicka

(57) ABSTRACT

A running tool for delivering a hanger into a wellcomprises a main body. In addition, the running tool comprise an attachment means for connecting a hanger to the main body. Further, the running tool comprises a sleeve having an external profile and being rotatably mounted around the main body. The sleeve has engagement means for releasably connecting the sleeve to a landing ring mounted via a thread on the hanger such that rotational movement of the sleeve causes rotational and thus axial movement of the landing shoulder on the hanger.

19 Claims, 5 Drawing Sheets

(56) References Cited

U.S. PATENT DOCUMENTS

| | | | | |
|---|---|---|---|---|
| 3,811,335 | A | 5/1974 | Hunsberger | |
| 4,511,128 | A | 4/1985 | Dancsik | |
| 4,616,803 | A | 10/1986 | Schils | |
| 4,630,688 | A | 12/1986 | True et al. | |
| 5,145,006 | A | 9/1992 | June | |
| 5,383,519 | A | 1/1995 | Wright et al. | |
| 5,427,178 | A | 6/1995 | Bland | |
| 5,429,188 | A | 7/1995 | Cameron et al. | |
| 5,477,752 | A | 12/1995 | West et al. | |
| 5,875,841 | A | 3/1999 | Wright et al. | |
| 5,964,286 | A | 10/1999 | Cuppen | |
| 6,026,898 | A | 2/2000 | Bland et al. | |
| 6,199,630 | B1 * | 3/2001 | Blundell et al. | 166/78.1 |
| 6,269,709 | B1 | 8/2001 | Sangret | |
| 6,543,533 | B2 | 4/2003 | Meek et al. | |
| 6,640,892 | B1 | 11/2003 | Wright | |
| 6,834,717 | B2 | 12/2004 | Bland | |
| 7,770,649 | B2 | 8/2010 | Biester et al. | |
| 2002/0121367 | A1 | 9/2002 | Meek et al. | |
| 2003/0024709 | A1 | 2/2003 | Cuppen | |
| 2006/0225890 | A1 | 10/2006 | Ray | |
| 2007/0125541 | A1 * | 6/2007 | Bull et al. | 166/305.1 |
| 2010/0243261 | A1 * | 9/2010 | Fern et al. | 166/348 |

FOREIGN PATENT DOCUMENTS

| | | | |
|---|---|---|---|
| EP | 0854267 | A2 | 7/1998 |
| GB | 6288 | | 0/1912 |
| GB | 106900 | | 6/1917 |
| GB | 570600 | | 7/1945 |
| PL | 164102 | B1 | 6/1994 |
| SU | 1373930 | A1 | 2/1988 |

OTHER PUBLICATIONS

PCT International Search Report and Written Opinion for PCT/EP2008/063694, dated Mar. 20, 2009.

* cited by examiner

RUNNING TOOL

CROSS-REFERENCE TO RELATED APPLICATIONS

This application claims benefit of PCT Application No. PCT/EP2008/063696 filed Oct. 13, 2008, and entitled "Running Tool," which is hereby incorporated herein by reference in its entirety for all purposes.

STATEMENT REGARDING FEDERALLY SPONSORED RESEARCH OR DEVELOPMENT

Not Applicable.

BACKGROUND

This invention relates to a running tool for delivering a hanger into a well and, in particular, to a running tool which not only delivers the hanger into the well, but which also can be used to assist in applying the necessary tension to the hanger. The invention described in the current application finds particular benefit when used in conjunction with a system for rotating an element inside a pressure containing housing as set out in the applicant's co-pending European patent application no. EP07119220.7.

Accordingly, the running sleeve to which the present invention relates is particularly useful when used with a type of wellhead system known as "Tie back" which is used on wells with pre-drilled casing strings which are suspended at the seabed or mudline.

Whilst specifically applicable to this type of wellhead system, the invention may be used in other applications in which rotation of an element in a pressure containing housing is required.

In order to connect pre-drilled casing strings to a wellhead at the surface, which is typically located on a production platform, a means has to be provided in the surface wellhead to place the mudline to surface (tie back) casing strings in tension.

This requires that the casing suspension mechanism (hanger) within the wellhead provides a means of adjustment which conventionally comprises a threaded hanger landing ring. This ring is mounted on the casing hanger and is rotated, such that it is moved axially down the body of the casing hanger whilst the hanger is held at the required tension by tubular members that pass back to the surface. The landing ring is rotated by means of an engaging tool, which is in turn rotated by tubular members passing back to the surface, these tubular members being external to and concentric with the internal tubular member which are holding the casing hanger in tension. The landing ring is rotated down the body of the casing hanger until it abuts a landing shoulder such that the applied tension on the hanger cannot be released.

However, such an arrangement requires many different trips with various tools into the wellhead in order to apply the necessary tension, as the running tool itself cannot be utilised in an appropriate way such that the tension can be applied whilst the running tool is in place.

Accordingly, the present invention aims to provide a running tool which can be used for delivering a hanger into a well and which allows the necessary rotation and thereby tensioning to be applied to the hanger whilst the running tool is in place.

SUMMARY OF THE DISCLOSURE

According to the present invention, there is provided a running tool for delivering a hanger into a well, the running tool comprising:

a main body;

attachment means for connecting, in use, a hanger to the main body; and a sleeve having an external profile and being rotatably mounted around the main body, the sleeve having engagement means for, in use, releasably connecting the sleeve to a landing ring mounted via a thread on the hanger such that, in use, rotational movement of the sleeve causes rotational and thus axial movement of the landing ring on the hanger.

Thus, as the sleeve is able to "float" on and around the main body of the running tool, i.e. is moveable axially and rotationally, it can be driven by a suitably located drive means, for example, the rotation mechanism which is the subject of the invention in the applicant's co-pending application filed on the same day under that agent's reference AMS01072EP.

The sleeve is preferably axially slidable on the main body. The sleeve may be provided with an internal thread for engagement with a corresponding thread on the tool body. The sleeve may be provided with mating extensions at its lower end for engagement, in use, with slots in the hanger landing ring. The sleeve is preferably retained on the main body by a retaining ring.

The external profile on the sleeve is preferably shaped to permit axial and rotational movement of the sleeve, whilst retaining engagement with a worm gear, which, in use, is used to drive the sleeve. The external profile preferably includes helical grooves or teeth.

BRIEF DESCRIPTION OF THE DRAWINGS

One example of the present invention will now be described with reference to the accompanying drawings, in which.

DETAILED DESCRIPTION OF THE DISCLOSED EMBODIMENTS

Figure 1:
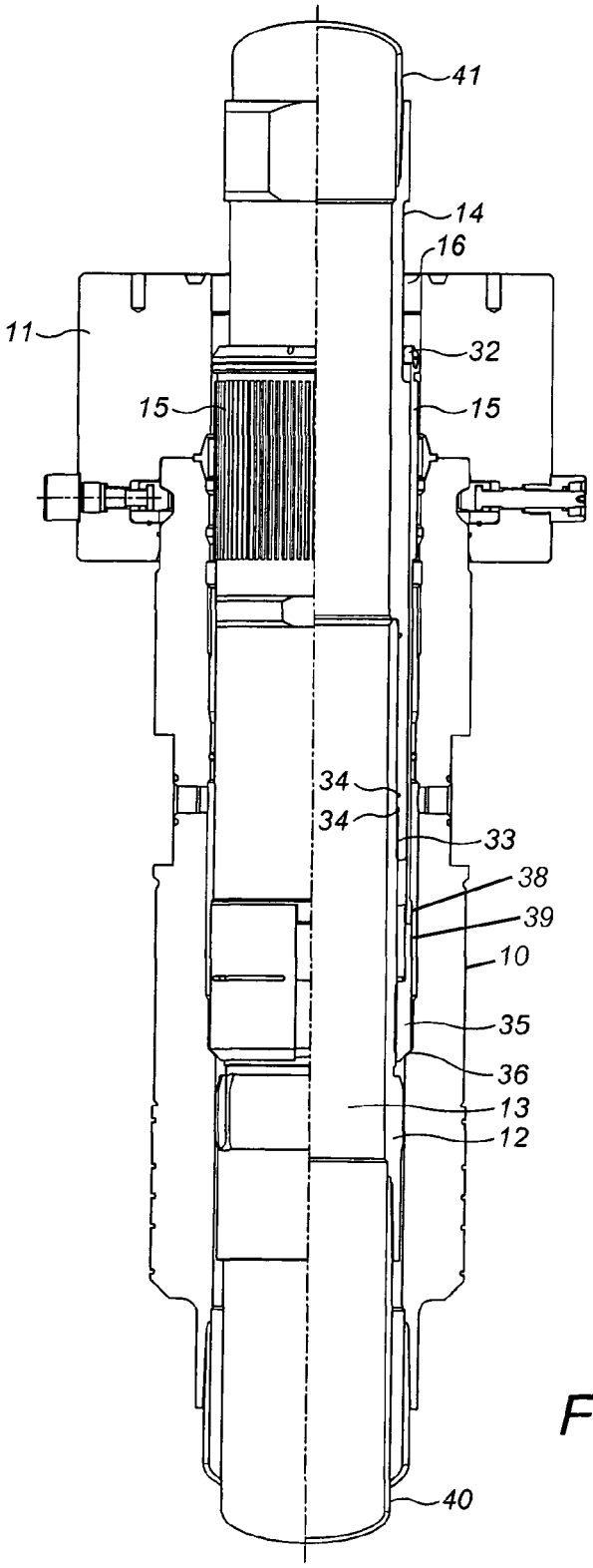
FIG. 1 shows a sectional view of a running tool with an adjustment sleeve in place.

FIG. 1 shows a wellhead housing 10 which is connected to the drilling system, typically comprising the blow out preventors (not shown), by means of a drilling adaptor 11. The drilling adaptor 11 contains the rotation mechanism of the invention which is illustrated in FIGS. 2 to 5.

A casing hanger 12 having a bore 13 therethrough is mounted on a hanger running tool 14. A drive sleeve 15 having an external thread of helical grooves or teeth 37 is mounted such that it is slidable axially and rotatable about the outer portion of the hanger running tool 14. The hanger 12 is to be located in well bore 16 and, using the present invention, tensioned and adjusted in a single trip.

Figure 2:
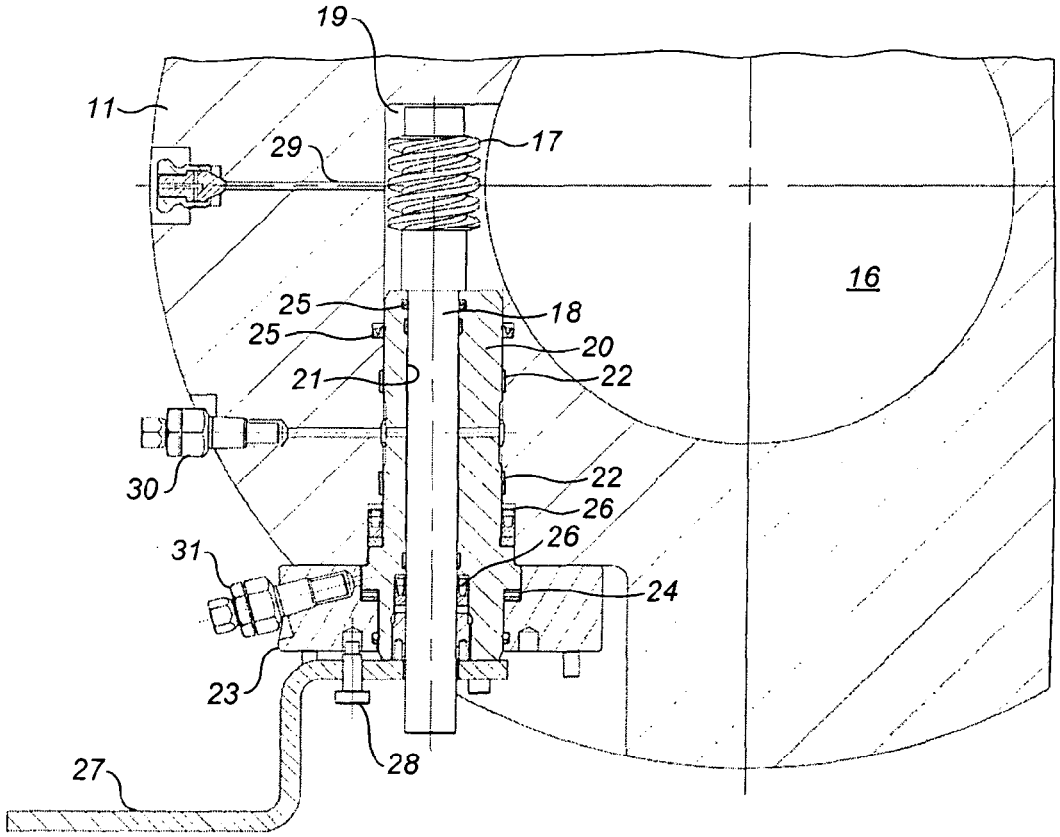
FIG. 2 is a cross-sectional view of the present invention with the worm gear retracted.

With reference now to FIGS. 2 to 5, the drilling adaptor 11 helps to define the well bore 16 and acts as a pressure containing housing. A worm gear 17, connected to an integral shaft 18, is located within a typically tangential bore 19, the tangential bore 19 opening into the well bore 16. In FIG. 2, the worm gear 17 is shown in the fully retracted position in which it does not extend into well bore 16 to any extent.

The worm gear 17 and its integral shaft 18 are rotatably mounted within a bushing 20 which has an eccentric bore 21. The bushing 20 is supported by bearing rings 22 such that it is rotatable within bore 20. A flange 23 retains the bushing and thrust bearings 24 ensure the freedom of movement of the bushing when under internal pressure. Seals 25 and 26 contain pressure from within the well bore 16.

A handle 27 for rotating the bushing is provided and is clearly marked to indicate the position in which the worm gear 17 is engaged and the position in which it is disengaged from the sleeve 15. A lock pin 28 controls the 180-degrees rotation of the bushing to engage or disengage the worm gear. Ports 29, 30 and 31 provide means for flushing and lubricating the mechanism.

In the disengaged position, the worm 17 is clear of the well bore 16 allowing full access down the well in the conventional manner.

Figure 5:
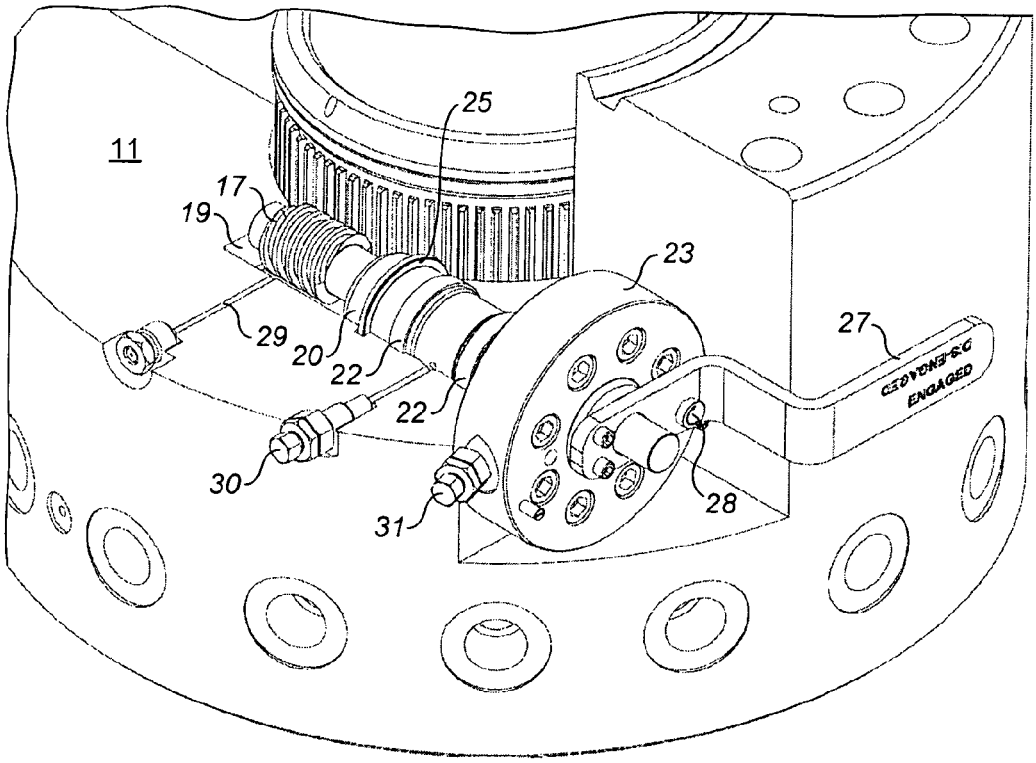
FIG. 5 shows a 3-D sectional view of the present invention with the worm gear engaged and a sleeve in the well bore.

In the engaged position shown in FIG. 5, the worm gear 17 engages with the mating profile of the helical drive gear or sleeve 15. This item is slidably mounted, both axially and rotationally, on hanger running tool 14 and is secured by a retaining ring 32. The hanger running tool 14 is connected to the hanger 12 by means of a thread 33 and pressure seals 34. A hanger adjustable landing ring 35 is threaded to the lower part of the hanger running tool, with the adjustable landing ring 35 being fluted and slotted to allow the flow of drilling fluids to pass the landing ring. Mating extensions 38 at the lower extremity of the helical drive gear or sleeve 15 engaged with slots 39 in the hanger adjustable landing ring 35.

Figure 4:
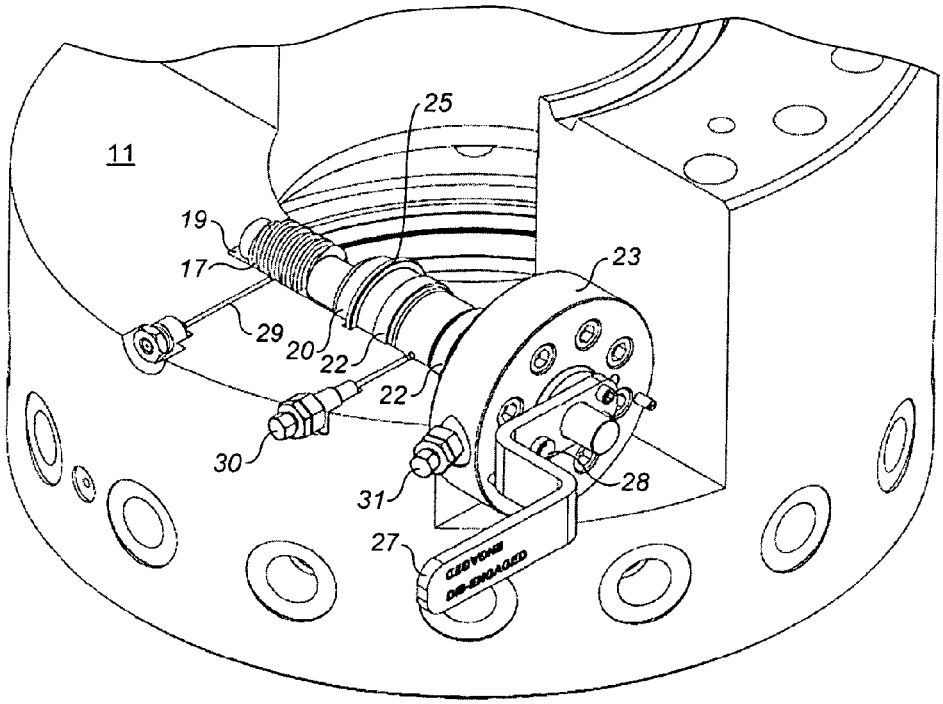
FIG. 4 shows a three dimensional, partial section view of the present invention with the worm gear disengaged.

A proposed installation procedure is as follows;

(1) The rotation mechanism, i.e. the worm gear, bushing and handle etc, is placed and locked in the retracted position as shown in FIGS. 2 and 4.

(2) The hanger 12 with the casing string attached is then run into the well using hanger running tool 14 and the casing string 40 engaged in the mud line hanger system.

(3) The required tension is then applied to the tie back string (i.e. the casing string 40) by the running tool landing string 41. At this time, the hanger adjustable landing ring 35 is clear of the landing shoulder 36 in the high-pressure housing 10.

Figure 3:
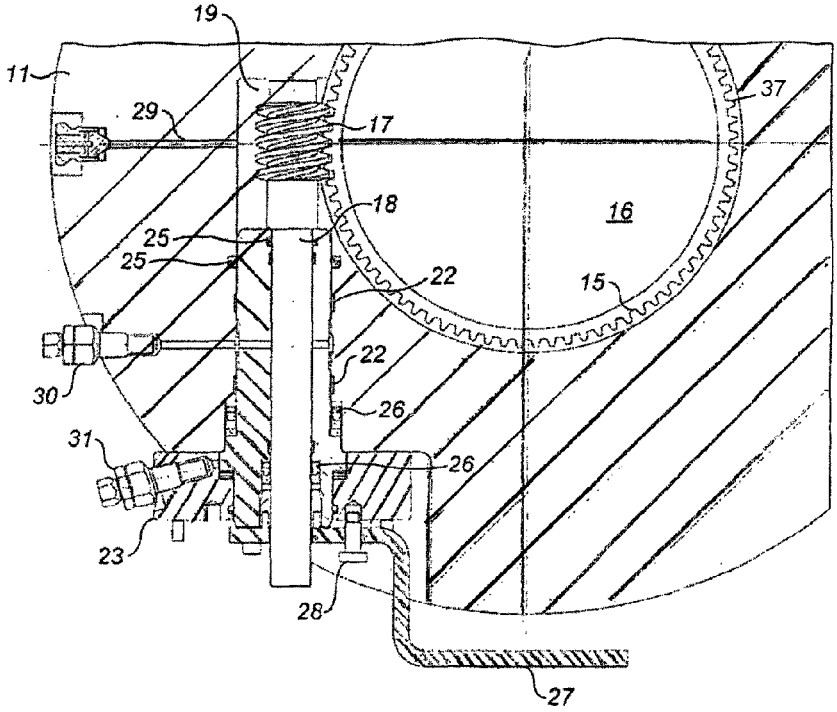
FIG. 3 is a cross-sectional view of the present invention with the worm gear engaged and a sleeve in the well bore.

(4) The worm is then engaged, by rotating the handle through 180-degrees and locked in the engaged position in FIGS. 3 and 5. This means that the worm 17 is engaged with mating teeth 37 on the helical drive gear 15.

(5) Rotation of the worm shaft 18, either by hand or with a powered actuator, causes the worm 17 to rotate the helical drive gear 15 which in turn rotates the landing ring 35. This rotation causes the landing ring 35 to move down axially on the hanger 12, thereby pulling the helical drive gear 15 down with the ring, as the helical drive gear is free to slide both axially and rotationally around the hanger running tool 14.

(6) When increased resistance is obtained this indicates that the hanger adjustable landing ring 35 is in contact with the landing shoulder 36 in the wellhead 10. At this time, the weight on the landing string 41 is relaxed.

(7) The worm gear is then placed and locked in the retracted position shown in FIGS. 2 and 4 such that the worm 17 no longer engages with the teeth 37 on the helical drive gear. Subsequent rotation of the landing string would release the hanger running tool 14 from the hanger 12, thereby allowing retrieval of the landing string and running tool to the surface, complete with the helical drive gear.

While various embodiments have been shown and described, modifications thereof can be made by one skilled in the art without departing from the spirit and teachings herein. The embodiments herein are exemplary only, and are not limiting. Many variations and modifications of the apparatus disclosed herein are possible and within the scope of the invention. Accordingly, the scope of protection is not limited by the description set out above, but is only limited by the claims which follow, that scope including all equivalents of the subject matter of the claims

The invention claimed is:

1. A running tool for delivering a hanger and a landing ring threadably mounted on the hanger into a well, the running tool comprising:

a main body;

an attachment means for releasably connecting the hanger to the main body;

a sleeve axially movably and rotatably mounted around the main body, the sleeve comprising an external profile comprising helical grooves or teeth shaped to permit axial and rotational movement of the sleeve relative to the main body; and wherein the sleeve includes engagement means for releasably connecting the sleeve to the landing ring such that rotation of the sleeve causes rotational and axial movement of the landing ring relative to the hanger.

2. The running tool of claim 1, wherein the sleeve is axially slideable relative to the main body.

3. The running tool of claim 1, wherein the sleeve includes an internal thread that engages a corresponding external thread on the main body.

4. The running tool of claim 1, wherein the engagement means comprises a plurality of extensions on a lower end of the sleeve that engage a plurality of mating slots in the hanger landing ring.

5. The running tool of claim 4, wherein the sleeve is retained on the main body by a retaining ring.

6. The running tool of claim 1, wherein the external profile of the sleeve is shaped to permit axial and rotational movement of the sleeve relative to the main body while retaining engagement with a worm gear adapted to drive the rotation of the sleeve about the main body.

7. A system for delivering a hanger into a well, the system comprising:

a running tool comprising a central axis, an upper end, and a lower end opposite the upper end;

a casing hanger releasably coupled to the running tool;

a sleeve axially movably and rotatably coupled to the running tool, wherein the sleeve comprises an upper end and a lower end opposite the upper end;

wherein an outer surface of the sleeve includes helical grooves or teeth adapted to engage a mating gear and shaped to permit axial and rotational movement of the sleeve relative to the running tool while remaining engaged with the mating gear; and a landing ring disposed about and threadingly coupled to the hanger and comprising an upper end releasably coupled to the lower end of the sleeve.

8. The system of claim 7, wherein the sleeve slidingly engages the running tool.

9. The system of claim 8, wherein the running tool is coaxially disposed about the hanger, the sleeve is coaxially disposed about the running tool, and the landing ring is coaxially disposed about the hanger.

10. The system of claim 8, wherein the upper end of the landing ring is coupled to the lower end of the sleeve with a plurality of mating extensions and slots.

11. The system of claim 7, wherein the sleeve is threadingly coupled to the running tool.

12. The system of claim 9, wherein the gear is a worm gear adapted to drive the rotation and axial movement of the sleeve relative to the running tool.

13. The system of claim 7, wherein the helical grooves or teeth are positioned proximal the upper end of the sleeve.

14. A method for positioning a casing hanger, comprising:

(a) coupling the hanger to a running tool;

(b) positioning a landing ring about the hanger;

(c) coupling the landing ring to the hanger with mating threads;

(d) axially movably and rotatably mounting a sleeve about the running tool, the sleeve comprising an external profile comprising helical grooves or teeth shaped to permit axial and rotational movement of the sleeve relative to the running tool;

(e) coupling the landing ring and the sleeve; and (f) rotating the sleeve relative to the running tool to adjust the axial position of the landing ring relative to the hanger.

15. The method of claim 14, wherein (a) further comprises a threadingly engaging the hanger to the running tool.

16. The method of claim 14, wherein (e) further comprises releasably coupling the sleeve to the landing ring with a plurality of mating extensions and slots.

17. The method of claim 14, wherein (f) further comprises rotating the sleeve relative to the running tool with a worm gear that engages a plurality of helical grooves or teeth formed on the outer surface of the sleeve.

18. The method of claim 14, wherein the sleeve includes an internal thread that engages an external thread on the running tool.

19. The method of claim 14, wherein the sleeve is free to rotate about the running tool and slide axially relative to the running tool.

* * * * *